US010183410B2

(12) United States Patent
Bagley

(10) Patent No.: US 10,183,410 B2
(45) Date of Patent: Jan. 22, 2019

(54) VEGETABLE STICK MAKER

(71) Applicant: Progressive International Corporation, Kent, WA (US)

(72) Inventor: Justin Bagley, Seattle, WA (US)

(73) Assignee: PROGRESSIVE INTERNATIONAL CORPORATION, Kent, WA (US)

( * ) Notice: Subject to any disclaimer, the term of this patent is extended or adjusted under 35 U.S.C. 154(b) by 0 days.

(21) Appl. No.: 15/717,644

(22) Filed: Sep. 27, 2017

(65) Prior Publication Data

US 2018/0085964 A1 Mar. 29, 2018

Related U.S. Application Data

(60) Provisional application No. 62/400,991, filed on Sep. 28, 2016.

(51) Int. Cl.
*B26D 7/06* (2006.01)
*B26D 3/26* (2006.01)

(52) U.S. Cl.
CPC ..... *B26D 3/26* (2013.01); *B26D 7/0608* (2013.01); *B26D 7/0683* (2013.01); *B26D 2210/02* (2013.01)

(58) Field of Classification Search
CPC ..... B26D 3/26; B26D 7/0608; B26D 7/0683; B26D 2210/02
See application file for complete search history.

(56) References Cited

U.S. PATENT DOCUMENTS 2,852,053 A * 9/1958 Berry ..... B26D 3/26 83/435.15
2,912,757 A * 11/1959 Knight ..... A47J 17/00 30/303
3,924,501 A * 12/1975 Cohen ..... B26D 3/26 83/404.3
4,095,518 A * 6/1978 Jones ..... A47J 19/00 83/435.15
4,436,025 A * 3/1984 Jones ..... B26D 3/26 83/435.15
4,557,053 A * 12/1985 Hadley, Jr. ..... B26D 3/185 30/114
4,569,280 A * 2/1986 D'Ambro ..... B26D 3/26 83/435.15
4,982,499 A * 1/1991 Fortin ..... A47J 17/02 30/123.5
5,101,718 A * 4/1992 Lin ..... A23N 4/18 30/302
5,207,137 A * 5/1993 Baril ..... B26D 1/553 30/117
5,337,480 A * 8/1994 Codikow ..... B26D 1/0006 30/114

(Continued)

*Primary Examiner* — Sean Michalski
(74) *Attorney, Agent, or Firm* — Lowe Graham Jones PLLC

(57) ABSTRACT

A vegetable stick maker includes a plunger and a hollow body, each of which has a height which is much greater than its width. The body is configured with one or more blades extending across the hollow interior of the body so that a vegetable pushed through the body by the plunger will encounter the blades and be sliced accordingly. The plunger includes a terminal end that diverges into a plurality of legs configured to receive the blades to facilitate slicing. A cap on the plunger prevents the plunger from extending beyond a rim of the body.

19 Claims, 8 Drawing Sheets

(56) References Cited

U.S. PATENT DOCUMENTS 5,421,249 A * 6/1995 Repisky ..... A23N 4/00 83/435.19
5,520,105 A * 5/1996 Healy ..... B26D 3/26 100/103
5,947,016 A * 9/1999 Repac ..... B26D 3/18 83/437.2
6,725,765 B1 * 4/2004 Mendenhall ..... B26D 1/0006 83/402
7,266,894 B1 * 9/2007 Hinckley ..... B26D 1/0006 30/302
7,340,835 B2 * 3/2008 Howman ..... A21C 15/04 30/114
7,587,968 B1 * 9/2009 Roberts ..... B26D 3/185 83/404.3
D605,478 S * 12/2009 Melton ..... B26B 3/04 D7/673
D649,413 S * 11/2011 Coursey ..... B26B 3/04 D7/673
8,495,941 B2 * 7/2013 Farid ..... B26D 3/185 30/114
8,555,763 B2 * 10/2013 Farid ..... B26D 3/185 30/114
8,561,529 B2 * 10/2013 Hoffman ..... A47J 25/00 99/537
D702,512 S * 4/2014 Harris ..... B26B 3/04 D7/673
8,726,521 B2 * 5/2014 Hauser ..... B26D 3/26 30/114
8,863,391 B2 * 10/2014 Bagley ..... B26D 1/547 30/114
9,067,329 B2 * 6/2015 Roes ..... A23N 4/22
9,622,620 B2 * 4/2017 Silberberg ..... A47J 43/28
D799,282 S * 10/2017 Maslana ..... B26B 3/04 D7/673
10,011,032 B2 * 7/2018 Repac ..... B26D 7/00
2009/0282990 A1 * 11/2009 Farnum ..... B26B 3/04 99/537
2012/0131800 A1 * 5/2012 Hauser ..... B26D 1/30 30/124
2017/0190066 A1 * 7/2017 Fastabend ..... B26D 1/03
2017/0265495 A1 * 9/2017 Amend ..... A23G 9/26
2017/0273868 A1 * 9/2017 Wang ..... A61J 7/0007
2018/0154536 A1 * 6/2018 Repac ..... B26D 3/185

* cited by examiner

VEGETABLE STICK MAKER

PRIORITY CLAIM

This application claims the benefit of U.S. provisional application No. 62/400,991 filed Sep. 28, 2017, the contents of which are incorporated by reference.

FIELD OF THE INVENTION

This invention relates generally to devices for cutting and slicing fruits and vegetables.

BACKGROUND OF THE INVENTION

It can be challenging to slice certain vegetables into sticks, such as in the case of carrots or celery. The dimension of the vegetable can make them difficult to work with, and simply slicing with a standard knife can be dangerous as the narrow vegetable may be difficult to hold while slicing. Existing devices for cutting and chopping are generally not directed to cutting long slender vegetable sticks.

SUMMARY OF THE INVENTION

A preferred vegetable stick maker includes a plunger and a hollow body, each of which has a height which is much greater than a width. The body is configured with one or more blades extending across the hollow interior of the body so that a vegetable pushed through the body will encounter the blades and be sliced accordingly. The plunger includes a terminal end that diverges into a plurality of legs configured to receive the blades to facilitate slicing.

In one example of the invention, the slicer includes a hollow body having a base and body sidewalls extending toward a rim to define an interior space.

One or more blades is seated within the interior space of the hollow body between the rim and the base and spanning the sidewalls, the blade or blades dividing the interior space into a plurality of sections.

In one version, the blade forms a V-shape having an apex and a pair of uprights in which the apex is relatively closer to the base than to the rim, and the uprights are relatively closer to the rim than to the base, the blade having a sharp edge facing toward the rim.

A plunger is sized and dimensioned to be received within the hollow body, the plunger having an upper end and an opposing lower end, with a cap at the upper end.

The cap is attached to (which can include being integrally formed with) a central barrel, the central barrel diverging into a plurality of legs which terminate at the lower end.

In a version, each of the plurality of legs further has an inclined interior face at the lower end, facing inward and toward the center of the plunger, each inclined face being formed with a gripping feature extending outward from the inclined face.

In a version, the blade comprises at least a first blade and a second blade, the first blade positioned to intersect the second blade, and wherein the plurality of sections comprises at least four sections.

In one version, the hollow body comprises a first height from the rim to an upper end of the uprights of the blade, the first height being at least three inches.

In an example, the central barrel further comprises an inclined surface between each of the plurality of legs.

In another example, the gripping feature comprises a fin, and each fin may be positioned to bifurcate each inclined face.

In a version, the hollow body further comprises a central band positioned between the base and the rim, the central band extending radially outwardly from the hollow body.

In another version, the hollow body is formed with an upper section, a lower section, the central band being positioned between the upper section and the lower section.

In a preferred example, the first blade and the second blade are mounted to the central band.

In an example, the hollow body comprises a flared region adjacent the rim, the flared section being flared radially outwardly.

In some examples, the plunger defines an axis from the upper end to the lower end, the plunger cap forms a plunger cap width along a cross section through the plunger cap and perpendicular to the axis, the barrel forms a barrel width along a cross section through the barrel and perpendicular to the axis, the plunger cap width being greater than the barrel width.

Yet other features are disclosed below, and any version of the invention may have any or all of the foregoing features.

BRIEF DESCRIPTION OF THE DRAWINGS

Preferred and alternative examples of the present invention are described in detail below with reference to the following drawings, in which the invention is illustrated to scale with respect to a preferred version of the invention.

DETAILED DESCRIPTION OF THE PREFERRED EMBODIMENT

Figure 1:
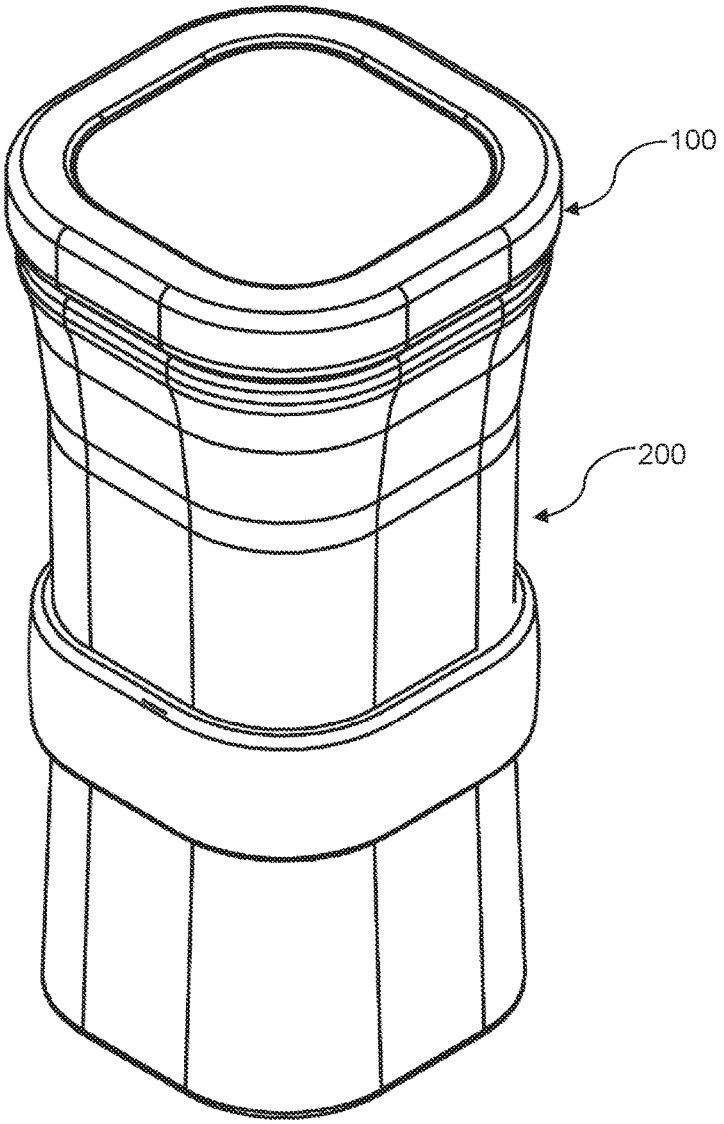
FIG. 1 is a top perspective view of a preferred vegetable stick maker.

With reference to FIG. 1, a vegetable stick maker includes a plunger 100 and a body 200. As illustrated, the plunger is seated within the hollow outer body.

Figure 2:
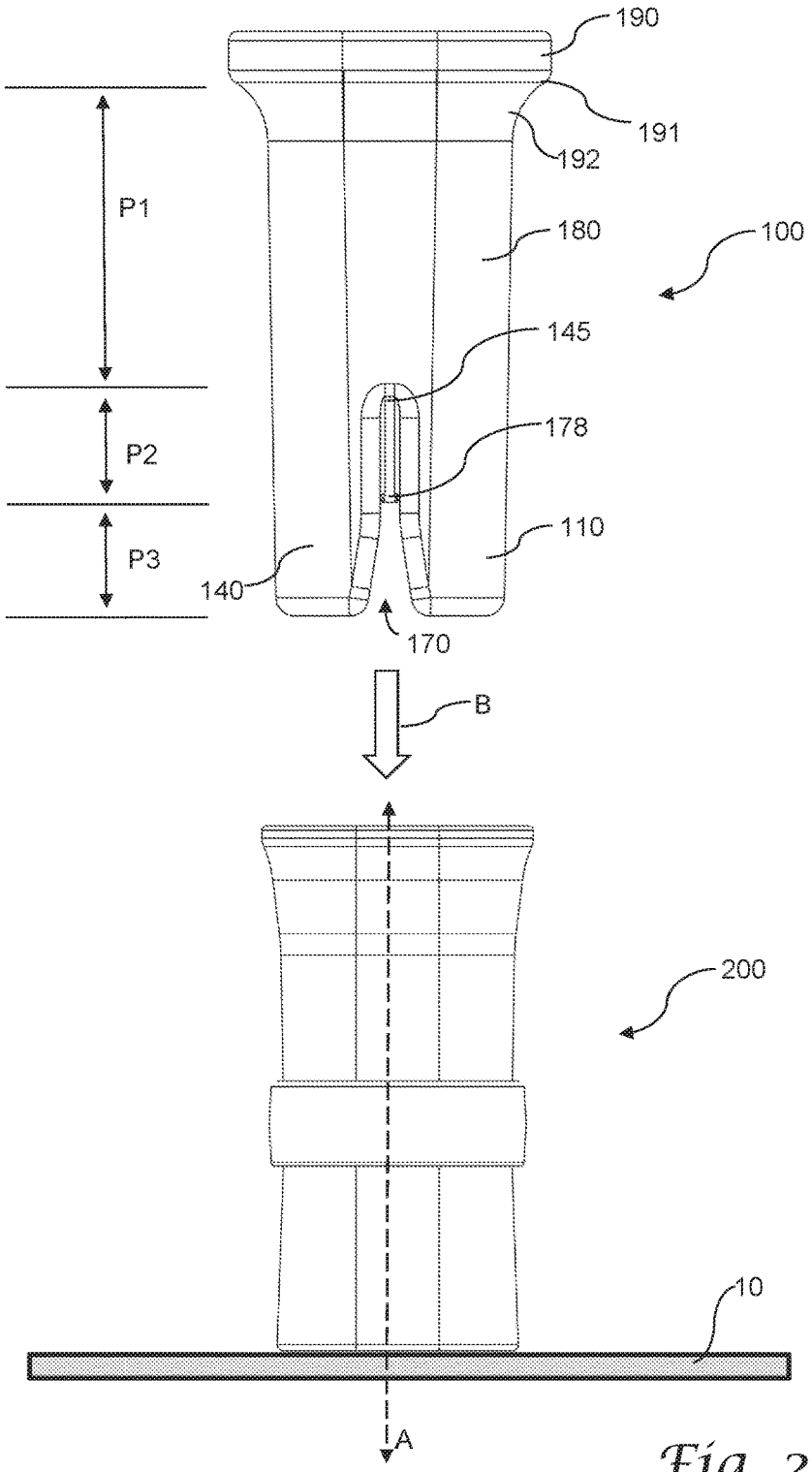
FIG. 2 is a front elevational view of a preferred vegetable stick maker, shown with a plunger separated from a body.

The general operation of the vegetable stick maker is shown in FIG. 2, in which the plunger 100 has been fully removed from the body 200. In this orientation, the body 200 is at rest on a horizontal surface 10 such as a kitchen countertop. A vegetable such as a carrot can be inserted into the top of the body 200 (in the direction of the arrow B positioned between the body 200 and the plunger 100). With a vegetable seated inside the body, the plunger 100 is then pressed downward in a direction indicated by the arrow B, and generally along a central axis A extending through the body 200, to push the vegetable through the blades within the body. Though illustrated as being at rest on a horizontal surface, in most cases (that is, with vegetables having any appreciable length), the body must be raised above the horizontal surface and held in the hand of a user to provide clearance for the vegetable as it is pushed through the body and the blades within it. Thus, in most uses the horizontal surface 10 of FIG. 2 is for a point of reference for discussion of the orientation and direction of movement of the components rather than a description of typical operation. Instead, in operation in which the vegetable is first placed inside the body, the body is best hand-held above a surface.

Figure 3:
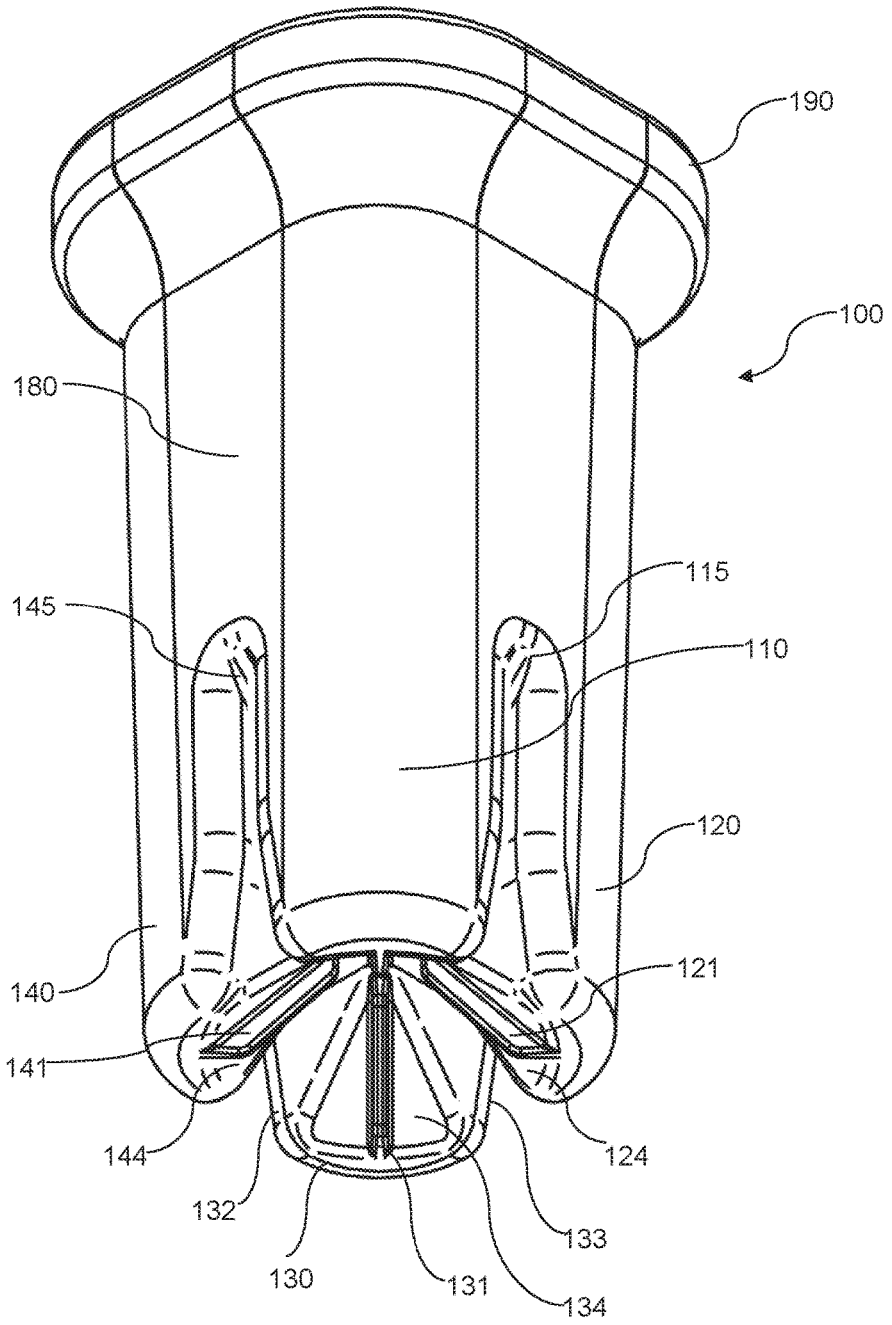
FIG. 3 is a bottom perspective view of a preferred vegetable stick maker plunger.

The preferred shape and configuration of the plunger is best seen in FIGS. 2 and 3. The plunger includes a central portion 180 which forms a barrel that diverges into one or more legs at a lower end (with the lower end being the portion adjacent the arrow 170) and a cap 190 at an opposing upper end. In the illustrated example, each of the barrel and the cap are shaped in horizontal cross section (that is, a cross-section defined by a plane extending through the plunger in which the plane is parallel with the horizontal surface 10 in FIG. 2, and perpendicular to the axis A) as a rectangle or square with rounded corners. Other versions may be rounded or have other shapes. The top and bottom views of FIGS. 4 and 5 further illustrate this preferred shape. Most preferably, the interior of the body 200 is formed with a complementary mating shape, though dimensioned slightly larger to accommodate the easy insertion and removal of the plunger.

In the illustrated version, the upper portion or cap 190 of the plunger is larger in cross section than the central portion or the barrel 180, preferably formed so that the barrel flares radially outward about its entire perimeter to transition between the barrel and the cap. The flared region 192 terminates at an upper edge 191 which will rest on an upper rim of the body, as described below. The cap thereby forms a surface that abuts against the body, such as at the upper edge 191, to prevent over-insertion of the plunger.

The lower end of the plunger, opposite the cap, terminates in a plurality of legs separated from one another by gaps between each of the legs. In the illustrated example, four legs 110, 120, 130, 140 are shown in the exemplary plunger. In other versions, depending on the number of blades and desired slices, there may be between two and eight legs. In yet other versions, a different number of legs may be provided. As seen in FIG. 2, a gap 170 is provided between an adjacent pair of legs 140, 110. Most preferably, substantially identical gaps are provided between each pair of adjacent legs, though not visible in FIG. 2.

Each pair of adjacent legs diverges from the barrel 180 at an upper juncture, such as juncture 145 shown in FIG. 2. In the bottom view of FIG. 4, four junctures 115, 125, 135, 145 are visible. The upper juncture is located at an outer peripheral location on the plunger, and forms an inclined ramp in the space between adjacent legs, with the ramp terminating at a central lower juncture 178 positioned at a central axis of the plunger.

In one example, the plunger is dimensioned with a distance P1 extending from the upper edge 191 to the juncture 145, a distance P2 from the upper juncture to the lower juncture, and a distance P3 from the lower juncture to the bottom of the plunger. In one version, the total height of the plunger is about five inches, with each of the distances P2 and P3 being about one inch. Accordingly, distance P1 is preferably about 3 inches or greater. Most preferably the plunger is formed from a plastic material.

Figure 4:
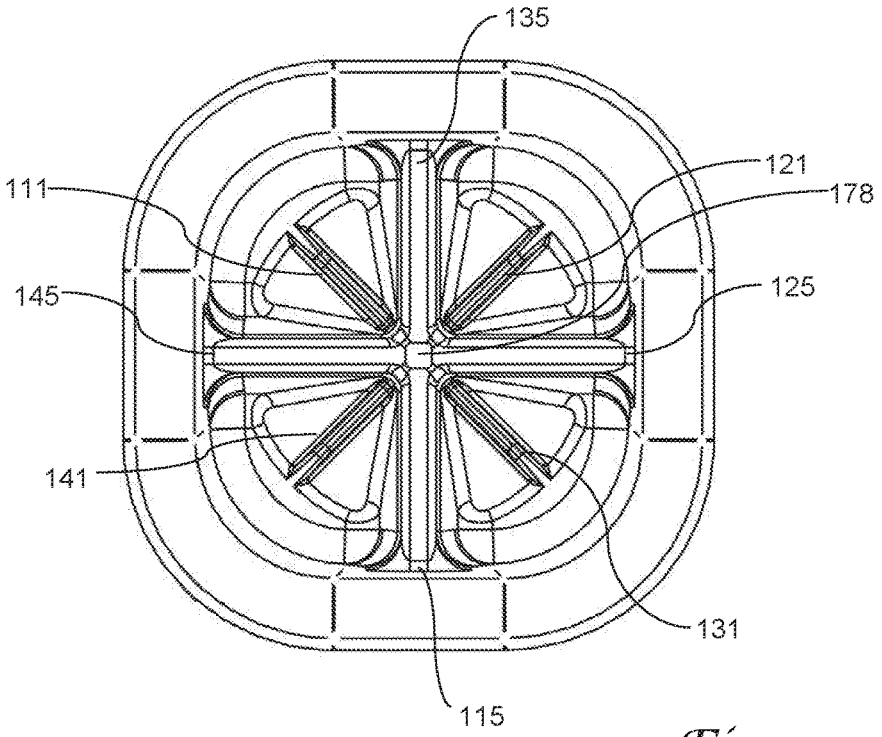
FIG. 4 is a bottom plan view of a preferred vegetable stick maker, with a plunger seated in a body.
Figure 5:
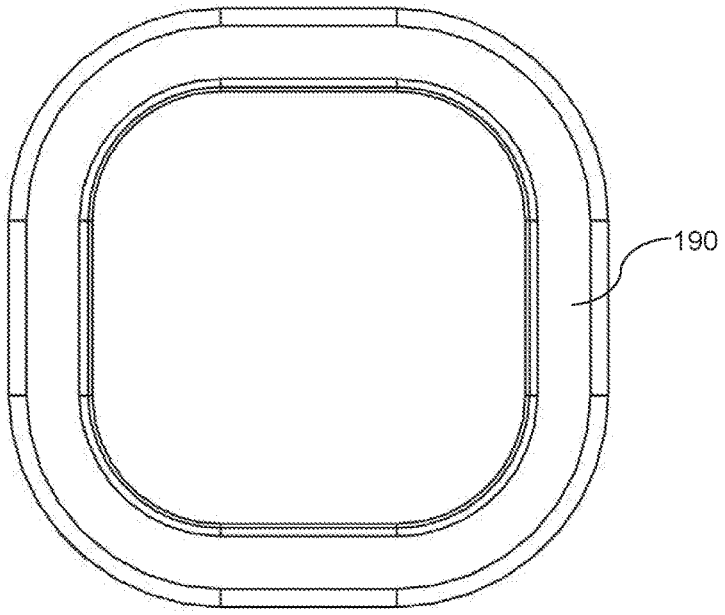
FIG. 5 is a top plan view of a preferred vegetable stick maker.

As seen in the front lower perspective view of FIG. 3, and the bottom view of FIG. 4, each of the legs 110, 120, 130, 140 terminates in a tapered distal end. Thus, for example, leg 130 includes a tapered left side 132 and a tapered right side 133. The orientation of the tapered portions is to narrow the perimeter of the leg, thereby increasing the separation space between adjacent legs at the distal ends.

Each leg further terminates in an inclined interior face 134, facing inward and toward the center of the plunger. As seen in FIG. 3, the interior face 134 of leg 130 is formed as an isosceles triangle having a base at the distal end of the leg and an apex positioned relatively closer to the barrel. The interior face in each case is bifurcated by a fin 111, 121, 131, 141. In the illustrated example, the fin extends axially away from the plunger. In one version, each fin is approximately ⅛ inch or ¼ inch in length. Though the preferred version includes an integral fin extending along the central portion of the inclined interior face, in other versions a different configuration may be used as a grip structure at the distal end of each leg, such as one or more spikes or other raised surfaces.

Figure 6:
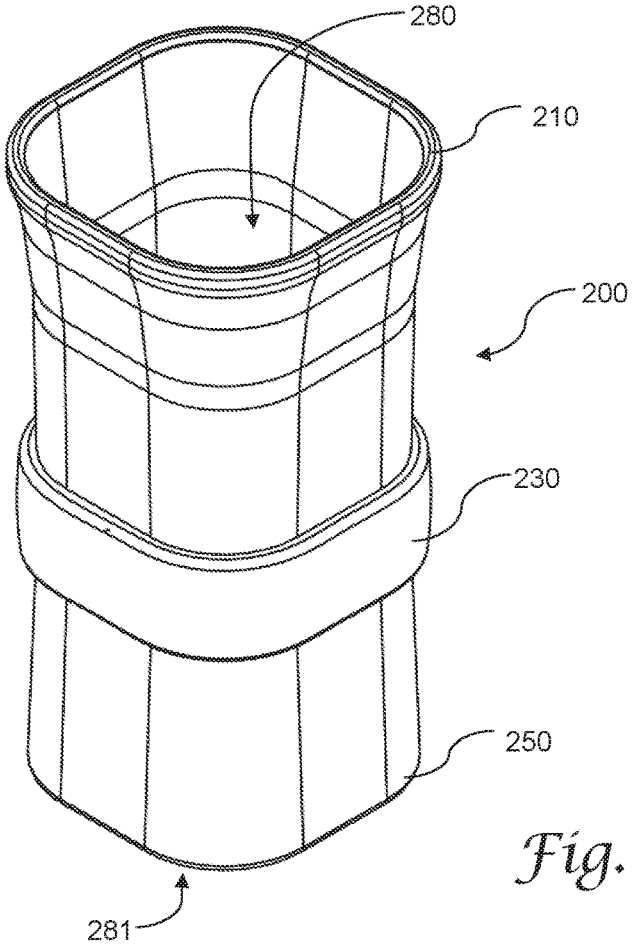
FIG. 6 is a top perspective view of a preferred body for a vegetable stick maker.

With reference to FIG. 6, the body 200 is formed with an outer shell having a hollow interior such that a vegetable may be inserted into the top opening 280 at the upper rim, and may emerge from the bottom opening 281 at the lower rim or base 250. The body is formed with sidewalls extending upwardly from the base 250 to the rim 210. A central band 230 extends about the perimeter of the body, extending radially outward from the sidewalls and providing a gripping surface.

Figure 7:
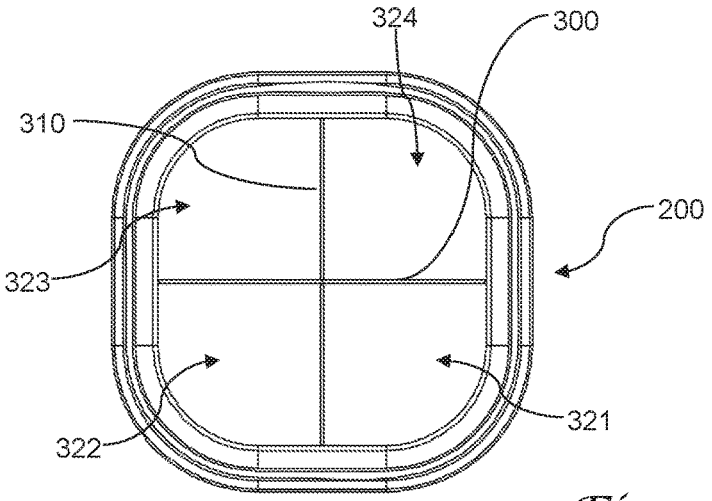
FIG. 7 is a top plan view of a preferred body for a vegetable stick maker.

FIG. 7 shows a top view of the body 200, and in this exemplary version the body includes a pair of blades 300, 310, each of which bifurcates the otherwise hollow interior of the body. The blades divide the interior of the body into sections, which in the illustrated version comprises four sections 321, 322, 323, 324 as viewed from the top or bottom. The blades are each formed with an upper sharpened surface, so that the sharpened edge is relatively closer to the rim or upper edge than the base.

Figure 8:
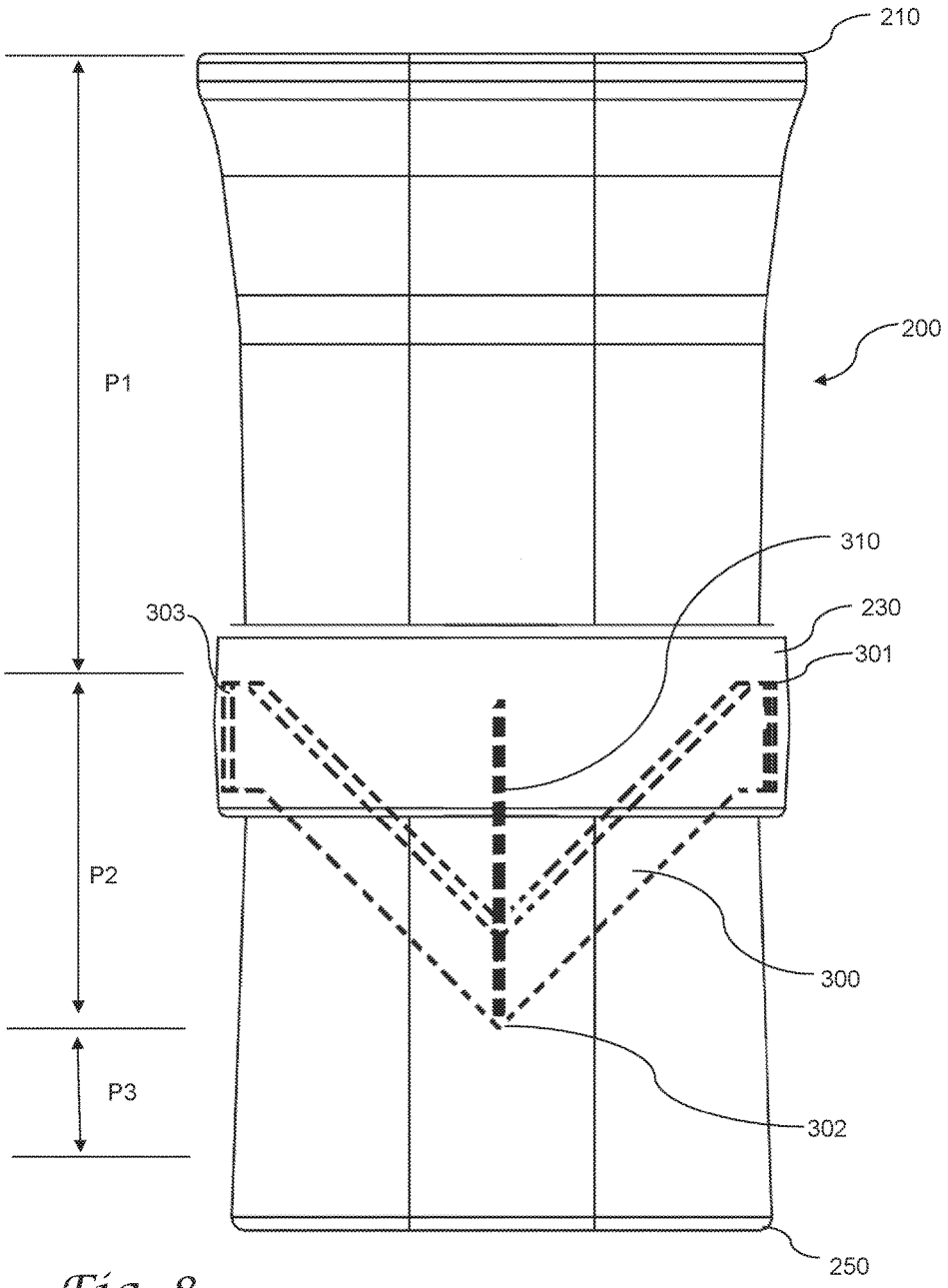
FIG. 8 is a front elevational view of a preferred body for a vegetable stick maker.

The structure of the body 200 is further illustrated in FIG. 8, showing a front elevational view of the body but with the internal blades visible in broken lines. Thus, it illustrates the body as including an upper rim 210 and a lower base 250, with sidewalls extending upwardly from the base to the rim. The central band 230 is provided at a location generally between the rim and the base, extending radially outwardly from the sidewalls. Each of the two blades 300, 310 in the preferred version is formed in a V-shape, having terminal ends 301, 303 and a downwardly-pointed apex 302 in the middle.

Figure 9:
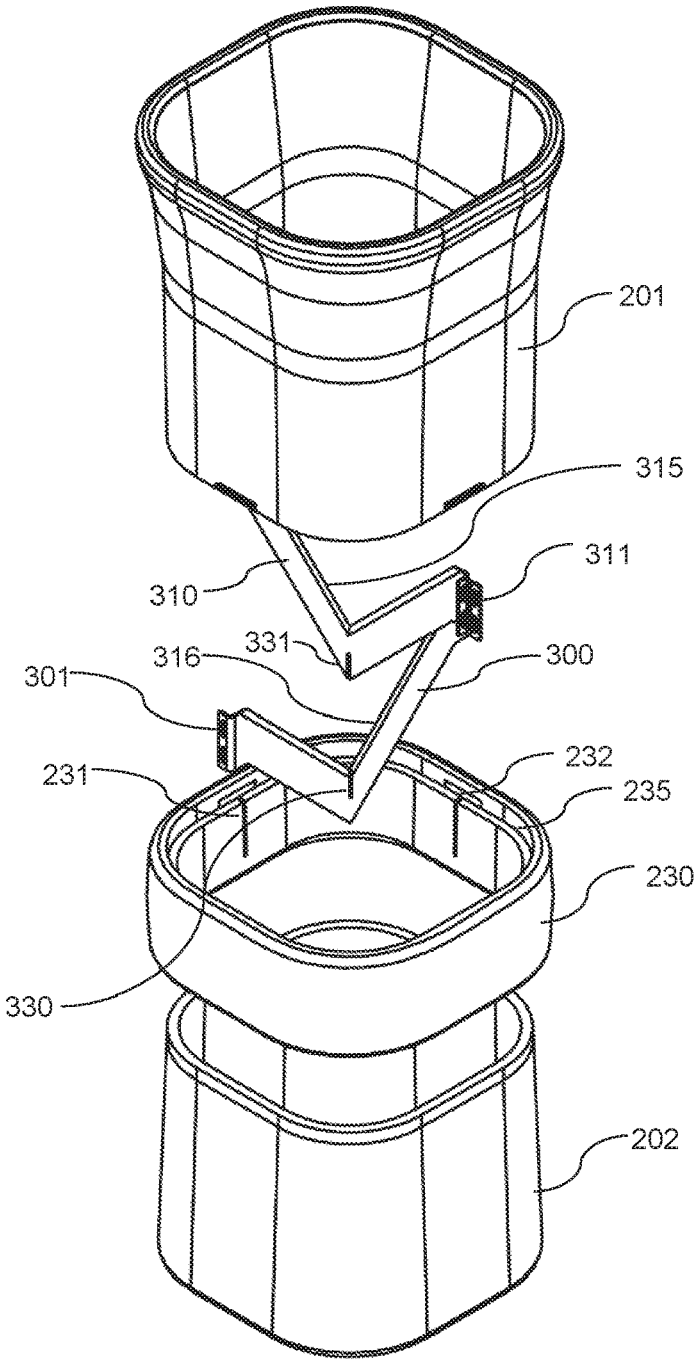
FIG. 9 is an exploded view of a preferred body for a vegetable stick maker.

As seen in FIGS. 8 and 9, each of the opposing terminal ends 301, 302 is configured with a flange configured to mount within the central band 230. In one example of the invention, the body is formed in three sections, including a lower section 202, the central band 230, and an upper section 201. In this example, the central band is formed with a plurality of vertical slits (e.g, 231, 232), each of the slits being configured to receive a flange or other mounting structure of one of the blades. Accordingly, each of the blades is seated in the central band by mounting them within the corresponding slits, with the flange or other mounting structure further being received within a circumferential channel 235 formed in the central band. The blades attach to one another at the apexes, with a first blade 300 having an upper channel 330 and the second blade 310 having a lower channel 331, the upper and lower channels interlocking with one another to join the blades at a right angle within the central band and the body.

In one example, each of the upper and lower sections 201, 202 mount to an interior seat formed in the central band such that the central band at least partially surrounds each of the upper and lower sections.

As seen in FIG. 8, the height and location of the blades in the body corresponds to the dimensions of the plunger. Thus, in one version the uppermost portion of the upper edges of the blades are located at a distance of approximately P1 below the upper rim of the body (though preferably slightly longer than P1 so that the blades do not quite reach the interior inclined surfaces of the plunger). The lowermost portion of the lower edges of the blades are at a distance P2 below the uppermost portion of the upper ends of the blades, providing an angle for the V shape that generally matches that of the inclines of the plunger from the upper juncture to the lower juncture. Most preferably, the distance P1 from the rim to the blades is greater than 2½ inches, or greater than about three inches, and the internal width of the rim is less than about 3 inches, or less than about 2½ inches, thereby making it difficult for a user's fingers to extend into the body to the point where they might reach the sharpened edge of the blades. The hollow body further has a height from the base to the rim which is greater than the diameter of the rim.

In use, a vegetable such as a carrot may be inserted into the body through the rim as described above, then the plunger is inserted into the body and pushed toward the blades along the direction of the central axis until the plunger forces the vegetable through the blades.

Figure 10:
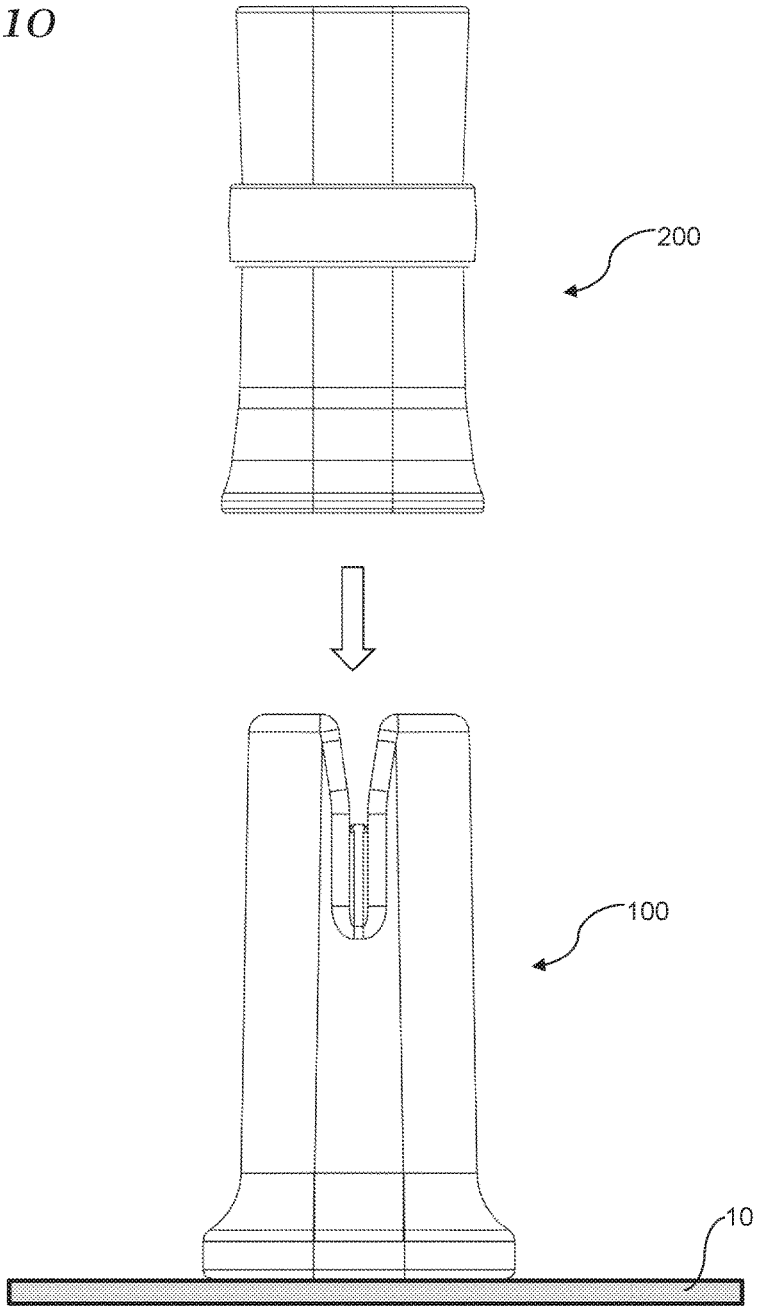
FIG. 10 is a front elevational view of a preferred vegetable stick maker, shown with a plunger separated from a body and inverted from the orientation of FIG. 2.

Alternatively, the process may be inverted as shown in FIG. 10. In this orientation, the plunger is placed on top of a horizontal surface 10 so that the cap is on the surface and the legs extend upwardly, away from the horizontal surface. A vegetable or other food item is placed atop the legs, where it is held by the fins or gripping surface on the inclined interior surfaces of the legs. Once in position, the body is lowered over the vegetable and the barrel, rim end first, to surround the vegetable and the plunger, moving in an axial direction until the blades pass through the vegetable and the body encounters the rim of the plunger. At that point, the vegetable will be sliced and can be removed from the base of the body. This particular orientation is advantageous in that it allows for increased leverage by placing the plunger on a countertop.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

I claim:

1. A vegetable slicer, comprising:

a hollow body having a base and body sidewalls extending toward a rim to define an interior space, the body defining a central axis extending from the base to the rim, a height from the base to the rim and a width perpendicular to the height, the height being greater than the width;

a blade seated within the interior space of the hollow body between the rim and the base and spanning the sidewalls, the blade dividing the interior space into a plurality of sections, the blade further forming a V-shape having an apex and a pair of uprights in which the apex is relatively closer to the base than to the rim, and the uprights are relatively closer to the rim than to the base, the blade having a sharp edge facing toward the rim; and a plunger sized and dimensioned to be received within the hollow body, the plunger having an upper end and an opposing lower end, the plunger having a plunger length from the upper end to the lower end in which the plunger length is greater than a plunger width;

the plunger further having a cap at the upper end, wherein when the plunger is positioned within the body the cap is positioned at the rim of the body;

the plunger further having a central barrel positioned between the upper end and the lower end, wherein the cap transitions to the central barrel, the central barrel diverging into a plurality of legs which terminate at the lower end, each of the plurality of legs further having an inclined interior face at the lower end, facing inward and toward the center of the plunger, each inclined face being formed with a gripping feature extending outward from the inclined face, wherein when the plunger is positioned within the body, the blade is positioned between the plurality of legs.

2. The vegetable slicer of claim 1, wherein the blade comprises at least a first blade and a second blade, the first blade positioned to intersect the second blade, and wherein the plurality of sections comprises at least four sections.

3. The vegetable slicer of claim 2, wherein the hollow body comprises a first height from the rim to an upper end of the uprights of the blade, the first height being at least three inches.

4. The vegetable slicer of claim 2, wherein the central barrel further comprises an inclined surface between each of the plurality of legs.

5. The vegetable slicer of claim 2, wherein the gripping feature comprises a fin.

6. The vegetable slicer of claim 2, wherein each fin is positioned to bifurcate each inclined face.

7. The vegetable slicer of claim 6, wherein the hollow body is formed with an upper section, a lower section, the central band being positioned between the upper section and the lower section.

8. The vegetable slicer of claim 2, wherein the hollow body further comprises a central band positioned between the base and the rim, the central band extending radially outwardly from the hollow body.

9. The vegetable slicer of claim 8, wherein the first blade and the second blade are mounted to the central band.

10. The vegetable slicer of claim 9, wherein the plunger defines an axis from the upper end to the lower end, the plunger cap forms a plunger cap width along a cross section through the plunger cap and perpendicular to the axis, the barrel forms a barrel width along a cross section through the barrel and perpendicular to the axis, the plunger cap width being greater than the barrel width.

11. The vegetable slicer of claim 10, wherein the blade comprises at least a first blade and a second blade, the first blade positioned to intersect the second blade, and wherein the plurality of sections comprises at least four sections.

12. The vegetable slicer of claim 11, wherein the gripping feature comprises a fin.

13. The vegetable slicer of claim 12, wherein the central section projects radially outwardly from the upper section and the lower section.

14. The vegetable slicer of claim 2, wherein the hollow body comprises a flared region adjacent the rim, the flared section being flared radially outwardly.

15. A vegetable slicer, comprising:

a hollow body having an open base and body sidewalls extending toward an open rim to define an interior space, the body sidewalls having an outer surface configured to be held in a hand of a user, the hollow body further flaring radially outward at the open rim;

a blade seated within the interior space of the hollow body between the rim and the base and spanning the sidewalls, the blade dividing the interior space into a plurality of sections, the blade further forming a V-shape having an apex and a pair of uprights in which the apex is relatively closer to the base than to the rim, and the uprights are relatively closer to the rim than to the base, the blade having a sharp edge facing toward the rim; and a plunger sized and dimensioned to be received within the hollow body, the plunger having an upper end and an opposing lower end, the plunger further having a cap at the upper end, the cap being configured to abut the open rim when the plunger is positioned within the hollow body, the cap further being attached to a central barrel, the central barrel being positioned within the body when the plunger is positioned fully within the hollow body, the barrel further diverging into a plurality of legs which terminate at the lower end of the plunger, each of the plurality of legs further having an inclined interior face at the lower end, facing inward and toward the center of the plunger, each inclined face being formed with a gripping feature extending outward from the inclined face, the plunger being selectively removable from the body or positioned within the body;

whereby each of the plurality of plunger legs is positioned within a corresponding one of the plurality of sections when the plunger is positioned within the hollow body.

16. The vegetable slicer of claim 15, wherein the central barrel further comprises an inclined surface between each of the plurality of legs.

17. The vegetable slicer of claim 16, wherein the hollow body is formed with an upper section, a lower section, and a central band positioned between the upper section and the lower section, the first blade and the second blade being mounted to the central band.

18. The vegetable slicer of claim 17, wherein the plunger defines an axis from the upper end to the lower end, the plunger cap forms a plunger cap width along a cross section through the plunger cap and perpendicular to the axis, the barrel forms a barrel width along a cross section through the barrel and perpendicular to the axis, the plunger cap width being greater than the barrel width.

19. A method of slicing a vegetable, comprising:

placing a cap of a plunger on a horizontal surface, the plunger having an first end and an opposing second end, the plunger cap being at the first end, the cap being attached to a central barrel, the central barrel diverging into a plurality of legs which terminate at the second end, each of the plurality of legs further having an inclined interior face at the second end, facing inward and toward the center of the plunger, each inclined face being formed with a gripping feature extending outward from the inclined face, the plunger further defining a plunger axis extending perpendicularly to the horizontal surface;

placing the vegetable atop the plurality of legs of the plunger; and moving a hollow body axially toward the vegetable and the plunger so that the body surrounds the plunger, the body having a base and body sidewalls extending toward a rim to define an interior space, the body further having a plurality of blades seated within the interior space of the hollow body between the rim and the base and spanning the sidewalls, the blade dividing the interior space into a plurality of sections, the blade further forming a V-shape having an apex and a pair of uprights in which the apex is relatively closer to the base than to the rim, and the uprights are relatively closer to the rim than to the base, the blade having a sharp edge facing toward the rim.

* * * * *